US008444245B2

(12) United States Patent
Furuhata

(10) Patent No.: US 8,444,245 B2
(45) Date of Patent: May 21, 2013

(54) IMAGE RECORDING APPARATUS AND CONTROLLING METHOD THEREOF

(75) Inventor: Tsuyoshi Furuhata, Tokyo (JP)

(73) Assignee: Riso Kagaku Corporation, Tokyo (JP)

( * ) Notice: Subject to any disclaimer, the term of this patent is extended or adjusted under 35 U.S.C. 154(b) by 278 days.

(21) Appl. No.: 12/913,962

(22) Filed: Oct. 28, 2010

(65) Prior Publication Data

US 2011/0109681 A1 May 12, 2011

(30) Foreign Application Priority Data

Nov. 6, 2009 (JP) ..... 2009-255209

(51) Int. Cl.
*B41J 29/393* (2006.01)

(52) U.S. Cl.
USPC ..... 347/19

(58) Field of Classification Search
USPC ..... 347/19, 104
See application file for complete search history.

(56) References Cited

U.S. PATENT DOCUMENTS

| | | | | |
|---|---|---|---|---|
| 4,778,272 | A * | 10/1988 | Asakura | 356/625 |
| 6,259,868 | B1 * | 7/2001 | Fujii et al. | 399/45 |
| 7,197,272 | B2 * | 3/2007 | Suzuki | 399/370 |
| 7,227,164 | B2 * | 6/2007 | Sakai et al. | 250/559.24 |
| 2007/0165059 | A1 * | 7/2007 | Nishizaka | 347/19 |
| 2008/0080921 | A1 * | 4/2008 | Yasue et al. | 400/605 |

FOREIGN PATENT DOCUMENTS

| | | | |
|---|---|---|---|
| JP | 04-082765 | A | 3/1992 |
| JP | 2550558 | B2 | 8/1996 |

* cited by examiner

*Primary Examiner* — Julian Huffman
*Assistant Examiner* — Sharon A Polk
(74) *Attorney, Agent, or Firm* — Holtz, Holtz, Goodman & Chick, PC

(57) ABSTRACT

An image recording range setting unit is provided on a conveyance path of a recording medium, and estimates a width of the recording medium on the basis of a detection result of a medium side end detecting unit for detecting a position of one side end of the recording medium. A recording range, on which image recording is to be performed, is set on the basis of the estimated width, and an image recording process is executed on the recording range.

14 Claims, 12 Drawing Sheets

IMAGE RECORDING APPARATUS AND CONTROLLING METHOD THEREOF

CROSS-REFERENCE TO RELATED APPLICATION

This application is based upon and claims the benefit of priority of the prior Japanese Patent Application No. 2009-255209, filed on Nov. 6, 2009, the entire contents of which are incorporated herein by this reference.

BACKGROUND OF THE INVENTION

1. Field of the Invention

The present invention relates to an image recording apparatus, and more particularly, to an image recording apparatus capable of setting an image recording range even on a recording medium of an irregular size.

2. Description of the Related Art

Image recording apparatuses for conveying a recording medium of a printer, a copier, a facsimile or the like and for executing an image recording process (recording of image data) on one surface or both surfaces of the recording medium are generally known. Examples of such image recording apparatuses include an inkjet image recording apparatus for recording an image by jetting ink onto a recording medium, and an electrostatic image recording apparatus for executing an image recording process by using toner.

For example, in inkjet image recording apparatuses, a recording medium is fed and conveyed when a character or an image is recorded. While a recording medium is being conveyed, a character or an image is recorded by causing a plurality of ink nozzles provided in a nozzle row (recording head) to face the recording medium, for which a recording process is to be executed, and by jetting color inks onto the recording medium being conveyed.

Here, in order to obtain an output image of high quality and prevent the inside of an apparatus from being contaminated by ink, toner or the like, it is necessary that a recording medium is precisely conveyed and an image is recorded on an image recording range suitable for the size of the recording medium.

For this implementation, a configuration where positions of right and left ends of a recording medium being conveyed are detected by providing a mechanism for detecting the right and the left ends of the recording medium being conveyed and image recording is performed based on the detected positions of the ends of the recording medium is generally known.

For example, Japanese Laid-open Patent Publication No. 04-82765 (hereinafter referred to as Patent Document 1. This document is incorporated herein by reference) discloses an image forming apparatus that can detect an arbitrary medium size of a recording medium. The apparatus according to Patent Document 1 can detect the size of a recording medium being conveyed by providing a plurality of recording medium detectors on a conveyance path.

Additionally, Japanese Patent No. 2550558 (hereinafter referred to as Patent Document 2. This document is incorporated herein by reference) discloses an apparatus for correcting a printing start position on the basis of the amount of a paper deviation detected before printing by providing a detector for detecting the amount of paper deviation in a direction vertical to a conveyance direction of a recording medium.

SUMMARY OF THE INVENTION

An image recording apparatus in one aspect of the present invention for recording an image on a recording medium by picking up the recording medium from a paper feeding mechanism and conveying the recording medium on a conveyance path by a conveyance mechanism on the basis of information from a higher-level device includes a recording medium side end detecting unit, provided on the conveyance path of the recording medium, for detecting a position of one side end of the recording medium, and an image recording range setting unit for estimating a width of the recording medium on the basis of a detection result of the recording medium side end detecting unit, for setting a recording range to be recorded on the basis of the estimated width, and for executing an image recording process on the recording range.

A controlling method of an image recording apparatus in another aspect of the present invention for recording an image on a recording medium by picking up the recording medium from a paper feeding mechanism and conveying the recording medium on a conveyance path by a conveyance mechanism on the basis of information from a higher-level device includes detecting a position of one side end of the recording medium being conveyed on the conveyance path, estimating a width of the recording medium on the basis of a detection result, setting a recording range, on which image recording is to be performed, on the basis of the estimated width, and executing an image recording process on the recording range.

BRIEF DESCRIPTION OF THE DRAWINGS

The present invention will be more apparent from the following detailed description when the accompanying drawings are referenced.

DESCRIPTION OF THE PREFERRED EMBODIMENTS

Embodiments according to the present invention are described below with reference to the drawings.

The following description is provided by assuming a case, as an example, where an image recording apparatus according to the embodiments is configured as an inkjet printer. The image recording apparatus according to the embodiments may be an image recording apparatus other than a printer, such as a facsimile, a copier or the like. Moreover, a recording method may be, for example, an electrostatic recording method other than an inkjet method.

Figure 1:
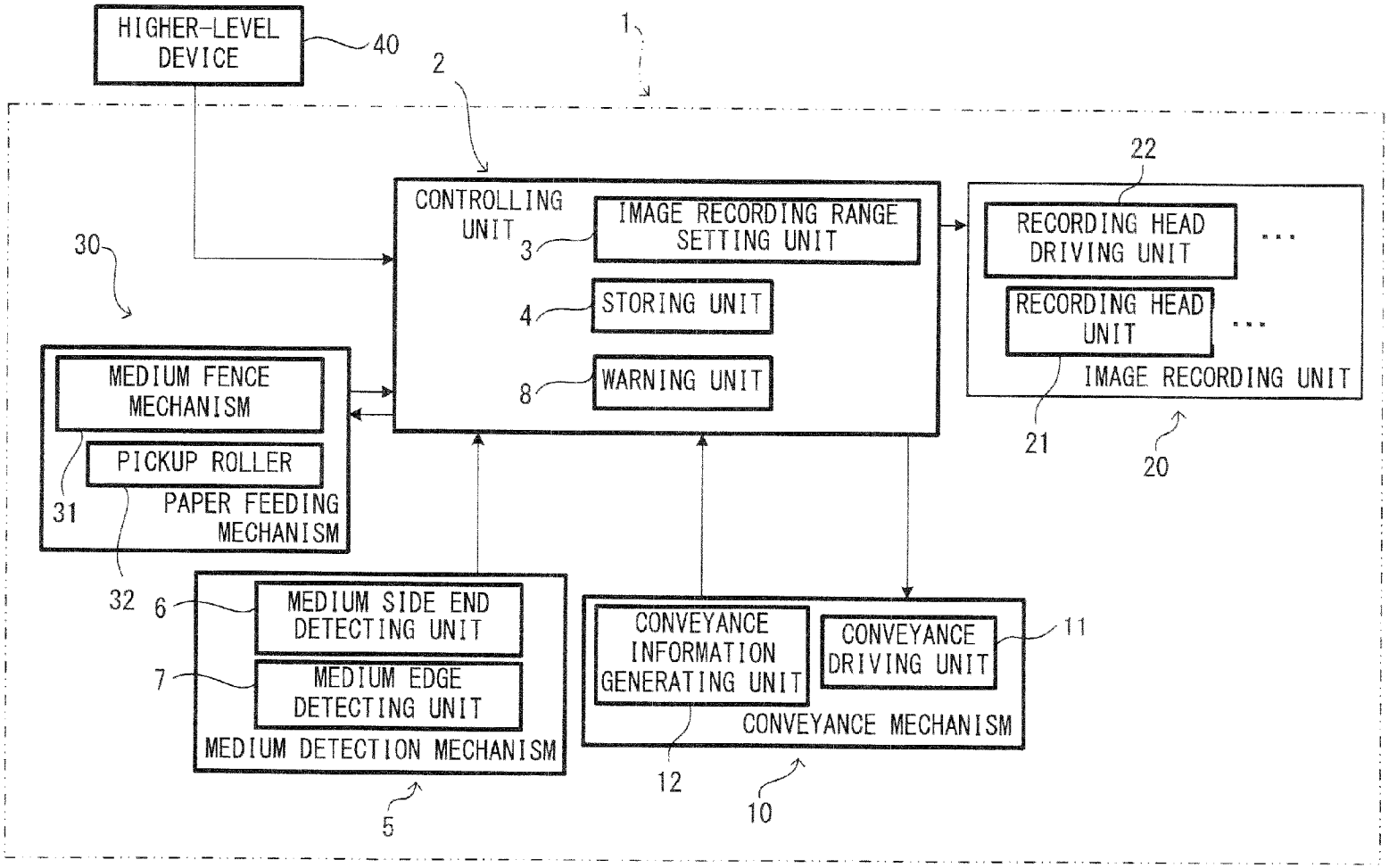
FIG. 1 is a block diagram illustrating a conceptual configuration of an image recording apparatus according to first to fourth embodiments.
Figure 2:
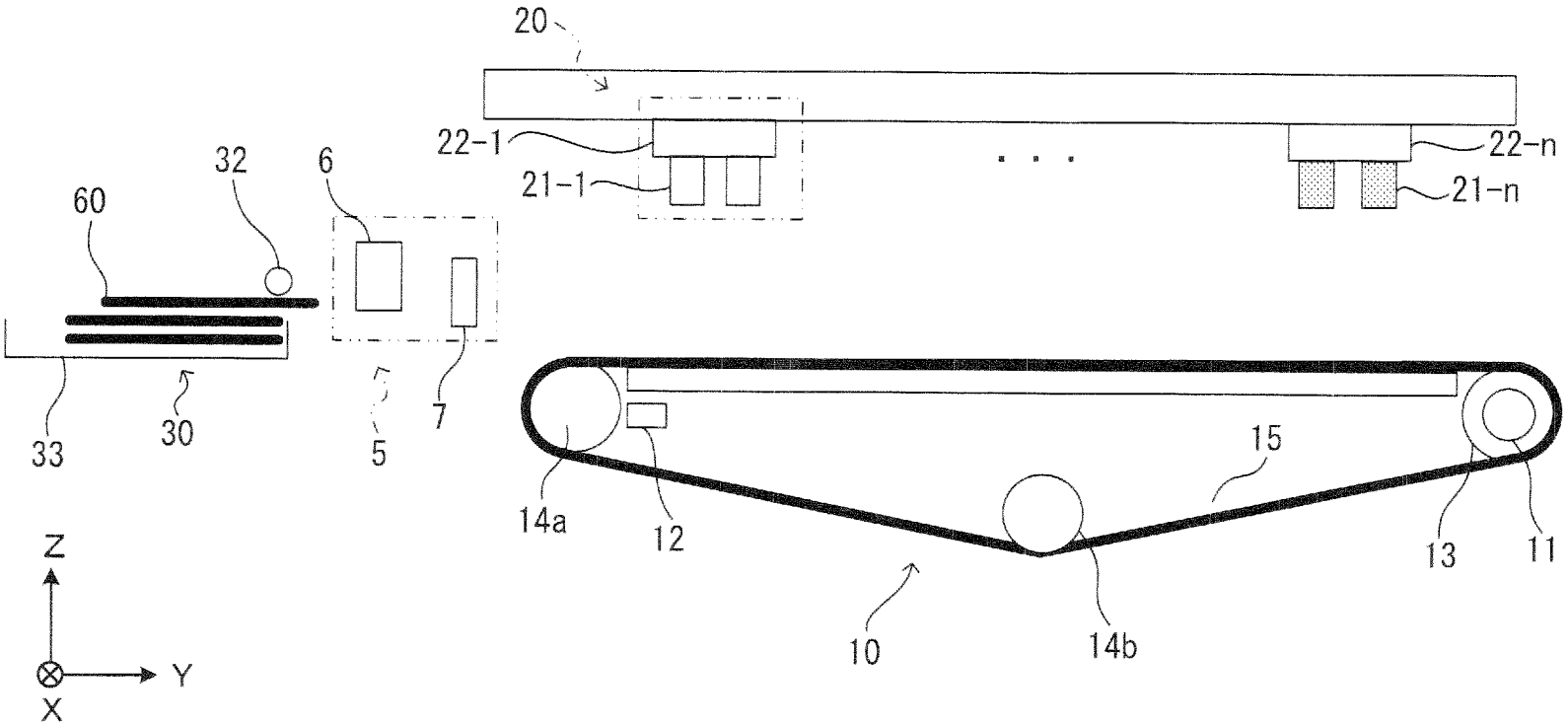
FIG. 2 is a side view illustrating a layout example of components that configure the image recording apparatus according to the first to the fourth embodiments.
Figure 3:
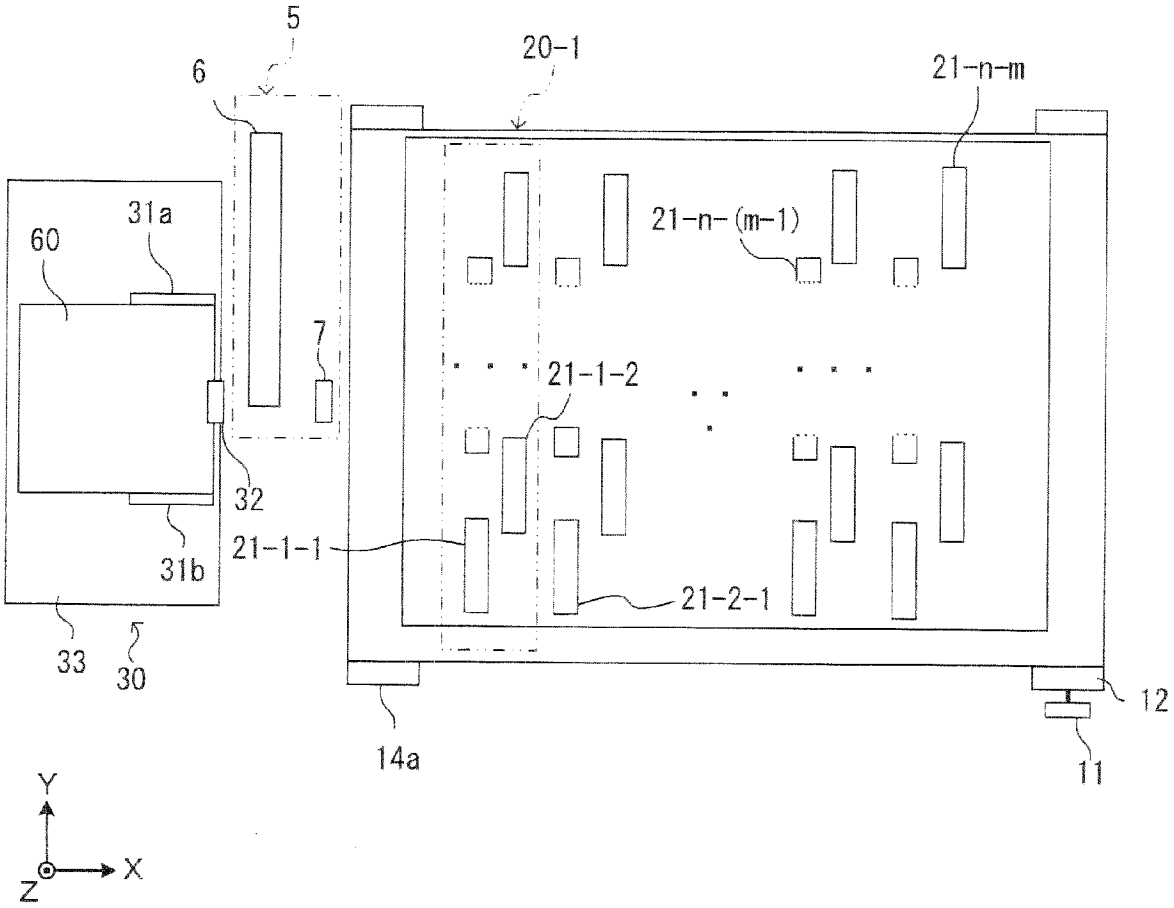
FIG. 3 is a top view illustrating the layout example of the components that configure the image recording apparatus according to the first to the fourth embodiments.

FIG. 1 is a block diagram illustrating a conceptual configuration of an image recording apparatus according to first to fourth embodiments. FIG. 2 is a side view illustrating a layout example of components that configure the image recording apparatus according to the first to the fourth embodiments. FIG. 3 is a top view thereof.

The image recording apparatus illustrated in FIGS. 1 to 3 is configured as a full-line color printer. In this image recording apparatus, recording heads in each of which a plurality of nozzles for jetting ink are formed in a direction (main scanning (direction) orthogonal to a conveyance direction of a recording medium are separately provided for respective ink colors in the conveyance direction (sub-scanning direction).

In the following description, the direction orthogonal to the conveyance direction of a recording medium (main scanning direction) is referred to as an X direction or a width direction of the recording medium, the conveyance direction of the recording medium (sub-scanning direction) is referred to as a Y direction, and a direction vertical to an X-Y plane is referred to as a Z direction.

An example of a configuration of an image recording apparatus according to the present invention is initially described.

The image recording apparatus 1 according to the first to the fourth embodiments includes at least a paper feeding mechanism 30 for feeding a recording medium 60, a conveyance mechanism 10 for conveying the recording medium 60 passed from the paper feeding mechanism 30, a medium detection mechanism 5 for detecting side ends of the recording medium 60 being conveyed and edges of the recording medium 60 in the conveyance direction, an image recording unit 20 for executing an image recording process on the recording medium 60, a storage unit, not illustrated, for storing the recording medium 60 on which the recording process has been executed, and a controlling unit 20 for controlling the image recording apparatus.

The paper feeding mechanism 30 includes a medium fence mechanism 31, a pickup roller 32, and a storage cassette 33. The paper feeding mechanism 30 is provided on the most upstream side of a conveyance path of the recording medium 60. After setting recording media 60 in the storage cassette 33, a user aligns the recording media 60 by sandwiching the right and the left ends of the recording media 60 with fences 31*a* and 31*b* as a result of moving the medium fence mechanism 31. The medium fence mechanism 31 presses, from both sides, both of the ends of the recording media 60 that orthogonal to the conveyance direction so that the midpoint of the conveyance path aligns with the center of the recording media 60, and thereby the recording media 60 conveyed from the storage cassette 33 are conveyed along the approximate midpoint of the conveyance path.

Once the recording process is started, the controlling unit 2 notifies the pickup roller 32 to feed the recording media 60. Upon receipt of this notification, the pickup roller 32 touches the topmost recording medium 60 stored in the storage cassette 33, and picks up the recording media 60 one by one, and conveys the recording media 60 to the medium detection mechanism 5 and conveyance mechanism 10, which are positioned downstream.

The medium detection mechanism 5 includes a medium side end detecting unit 6 and a medium edge detecting unit 7. The medium detection mechanism 5 is arranged between the paper feeding mechanism 30 and the conveyance mechanism 10. The medium side end detecting unit 6 is configured, for example, with a contact image sensor (CIS). Upon detection of a position of one side end (such as the left end) of the recording medium 60 conveyed from the paper feeding mechanism 30, the medium side end detecting unit 6 notifies the controlling unit 2 of the detected position. The medium edge detecting unit 7 detects front and rear edges of the recording medium 60, and notifies the controlling unit 2 of the detected edges. The controlling unit 2 corrects an image recording position on the basis at the notifications from the medium side end detecting unit 6 and the medium edge detecting unit 7, and determines image recording start and end timings and the image recording position.

The conveyance mechanism 10 includes a conveyance driving unit 11, a conveyance information generating unit 12, a driving roller 13, driven rollers 14 (14*a*, 14*b*), and a conveyance member 15. A conveyance surface of the conveyance mechanism 10 is provided to face ink jetting holes of a plurality of recording head units 21. The conveyance member 15 is mounted on the driving roller 13 and the driven rollers 14. The conveyance member 15 is rotated by driving the driving roller 13 on the basis of a control instruction issued from the controlling unit 2, and starts conveying the recording medium 60 passed from the paper feeding mechanism 30 while the recording medium 60 is secured to the conveyance member 15 by a fan not illustrated.

The driven rollers 14 are provided with a conveyance information generating unit 12 including, for example, a rotary encoder. The conveyance information generating unit 12 generates a pulse corresponding to the amount of a move of the conveyance member 15, and notifies the controlling unit 2 of the generated pulse.

The image recording unit 20 includes the recording head units 21 and recording head driving units 22. The image recording unit 20 executes a recording process on the basis of a control instruction issued from the controlling unit 2. In the image recording unit 20, a plurality of recording heads that jet ink in accordance with a driving signal respectively from the recording head units 21 are directly provided in a length exceeding a maximum width of the recording medium in design. The recording head driving units 22 respectively control the recording head units 21 on the basis of information notified from the controlling unit 2, so that image information of each line is recorded on the recording medium 60.

Additionally, a higher-level device 40 such as a host computer, which notifies the controlling unit 2 of job information that is information about the recording process (image recording), is connected to the image recording apparatus 1.

The higher-level device 40 notifies the controlling unit 2 of the job information (image data, an image data size, a size of a recording medium, a direction of the recording medium, a type of the recording medium, the number of recording media to be recorded, one surface/both surfaces recording) on the basis of an instruction issued from a user.

The controlling unit 2 includes an image recording range setting unit 3, a storing unit 4, and a warning unit 8. The controlling unit 2 is configured, for example, with a processing circuit such as an MPU or the like, and includes a memory, not illustrated, for storing a program and image data, which are needed for controls and processes. The controlling unit 2 notifies the image recording unit 20 of data of one line to n lines of the image data on the basis of the image data stored in the memory of the image recording apparatus 1, and causes the image recording unit 20 to execute the recording process.

The image recording range setting unit 3 included in the controlling unit 2 determines an image recording range of the recording medium being conveyed on the basis of the information notified from the medium detection mechanism 5, and the information notified from the higher-level device 40. Then, the controlling unit 2 determines a recording head to jet ink onto the image recording range, and issues a control instruction to drive the recording head unit 21 to the recording head driving unit 22. The storing unit 4 stores information of the recording head unit 21 to be driven according to the size of the recording medium 60, which is detected by the medium side end detecting unit 6. The storing unit 4 also prestores an interval distance between recording heads in design of the image recording apparatus 1 as the number of pulses output from the rotary encoder of the conveyance information generating unit 12 by converting the interval distance to the number of pulses along with the information of the recording head unit 21. In other words, the storing unit 4 stores the start timing of jetting ink from the nozzles as the number of pulses output from the conveyance information generating unit 12. The controlling unit 2 drives the recording head driving unit 22 when the number of pulses of the encoder, which is output from the conveyance information generating unit 12, and the number of pulses of the rotary encoder, which corresponds to the recording timing of each nozzle row and is prestored in the storing unit 4, match. According to the driven recording head driving unit 22, ink is jetted from the nozzles onto the recording medium 60 held on the conveyance member 15 to execute the recording process.

The job information notified from the higher-level device 40 includes recording medium size specification information, recording medium height/width specification information, recording medium type specification information, the number of recording media to be recorded, one surface/both surfaces recording specification information, resolution specification information, information about image data to be recorded, and the like.

Upon receipt of the recording process start notification along with the job information from the higher-level device 40, the controlling unit 2 causes the paper feeding mechanism 30 to convey the recording media 60 one by one to the medium detection mechanism 5 and the conveyance mechanism 10 with a prescribed page gap.

In the medium detection mechanism 5, the front edge and the left end of the recording medium 60 are detected respectively by the medium side end detecting unit 6 and the medium edge detecting unit 7, and detection results are output to the controlling unit 2 as detection signals. The controlling unit 2 sets an image recording range on the basis of the detection signals from the medium side end detecting unit 6, and the information, notified from the higher-level device 40, of the recording medium 60 being conveyed, selects a recording head to be driven, and controls the recording head driving unit 22.

An image recording range setting method executed by the image recording apparatus 1 according to the first embodiment is described next.

Figure 4:
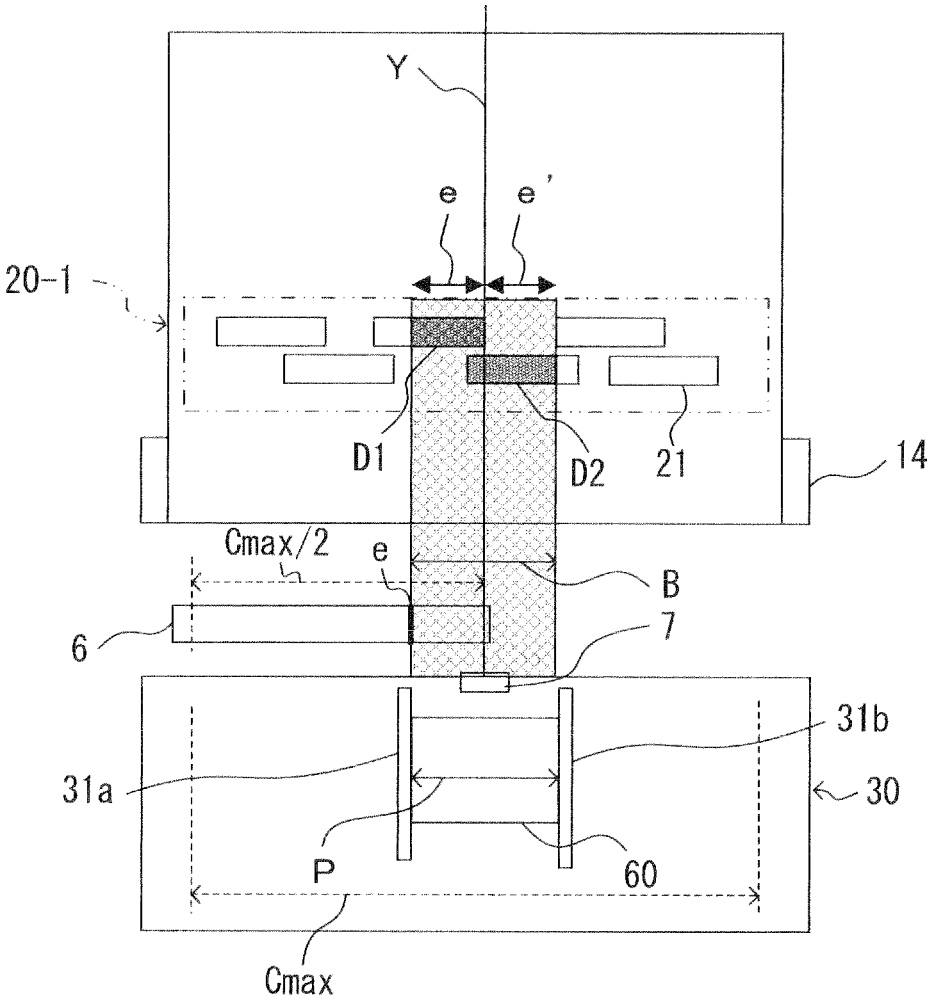
FIG. 4 illustrates an image recording range setting method in the first embodiment.

FIG. 4 illustrates the image recording range setting method according to the first embodiment.

In FIG. 4, it is assumed that a distance between the position of the left end of the recording medium 60, which is detected by the medium side end detecting unit 6, and a midpoint position of the conveyance path is e, a width of a recording head driving range, which is set by the image recording range setting unit 3, is B, a recording head positioned within the recording head driving range B is D, the midpoint position of the conveyance path in design is Y, a detection position in design, which can be detected based on information about the maximum width of the recording medium that can be held on the paper feeding mechanism 30 is Cmax, and a recording medium width of the recording medium 60 is P.

Assume that the paper feeding mechanism 30 does not include a detector for detecting the size of an irregular recording medium in the image recording apparatus 1 according to the first embodiment illustrated in FIG. 4. Also assume that a detection range of the medium side end detecting unit 6 is approximately one half of a detection length needed to detect a maximum recordable width of paper. The medium side end detecting unit 6 may be provided on either of the right and the left sides of the conveyance direction. FIG. 4 is an explanatory view of an example where the medium side end detecting unit 6 is provided on the left side of the conveyance direction to detect the left end of a recording medium. As described above, the image recording apparatus 1 according to the first embodiment has a simple configuration, whereby the apparatus can be implemented cost-effectively.

In the first embodiment, the width of the recording medium 60 is estimated based on the configuration where the position of the recording medium 60 is aligned by the paper feeding mechanism 30 so that the recording medium 60 is conveyed along the midpoint of the conveyance path.

Figure 5:
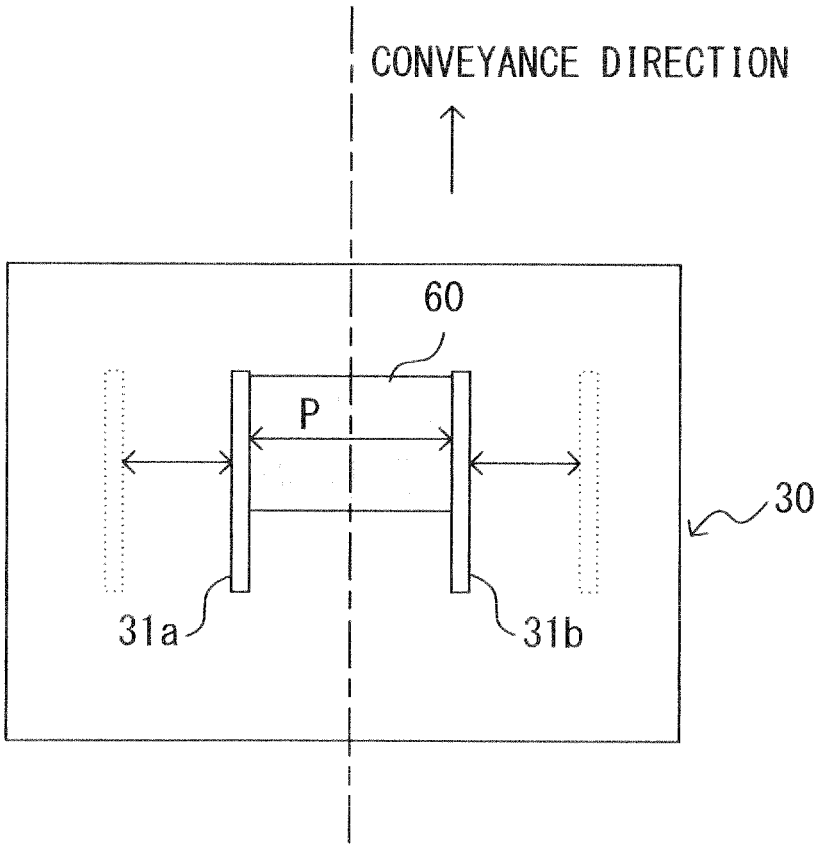
FIG. 5 illustrates a configuration of a paper feeding mechanism adopted in an image recording apparatus according to the first embodiment.

FIG. 5 illustrates a configuration of the paper feeding mechanism 30 used in the image recording apparatus 1 according to the first embodiment.

The paper feeding mechanism 30 illustrated in FIG. 5 includes the medium fence mechanism 31. The recording medium 60 having a width P set by the medium fence mechanism 31 is conveyed so that a midpoint Y of the conveyance path in design and the midpoint of the width P of the recording medium 60 match in accordance with an instruction of the controlling unit 2.

Upon detection of the front edge of the recording medium 60 by the medium edge detecting unit 7 positioned on the conveyance path, the controlling unit 2 starts counting an encoder pulse output from the conveyance information generating unit 12 by using a signal of the detection as a trigger.

In the meantime, when the recording medium 60 proceeds by being conveyed and the side end of the recording medium 60 reaches the medium side end detecting unit 6, the medium side end detecting unit 6 detects a side end position e of the recording medium 60, and the controlling unit 2 obtains the side end position e. The controlling unit 2 handles a distance between the detection position detected by the medium side end detecting unit 6 and the midpoint position Y of the conveyance path in the main scanning direction as the side end position e.

As described above, in the image recording apparatus 1 according to the first embodiment, the paper feeding mechanism 30 does not include a recording medium size detecting unit, and also the medium side end detecting unit 6 does not have a detection range of the entire width of the recording medium 60. Accordingly, the width P itself of the conveyed recording medium 60 cannot be measured.

Here, the recording medium 60 is conveyed so that the midpoint Y of the conveyance path in design aligns with the midpoint of the recording medium 60. Therefore, for the width of the recording medium being conveyed, the image recording range setting unit 3 estimates that a distance e' from the midpoint Y of the conveyance path to the right end of the recording medium 60 is equal to a distance e from the midpoint Y of the conveyance path to the left end of the recording medium 60. Then, the image recording range setting unit 3 sets the width P of the recording medium 60 to be e+e=2e on the basis of this estimation. If 2e is within a predetermined error range of a preset regular size of a recording medium, the image recording range setting unit 3 determines the recording medium width to be the regular size.

In the meantime, if 2e is riot within the predetermined error range of the regular size of the recording medium, the image recording range setting unit 3 determines the recording medium width P to be 2e.

Assume that the recording medium 60 further proceeds by being conveyed and the count value of the encoder pulse counted by the controlling unit 2 reaches a predetermined value. At this time, image recording is started by recognizing the recording range width 2e (the width of regular paper if the recording medium 60 being conveyed is determined to be the regular paper), which is set by the image recording range setting unit 3, as a recording range in the main scanning direction.

Assuming that the recording medium 60 further proceeds by being conveyed and the medium edge detecting unit 7 detects the rear edge of the recording medium 60, the controlling unit 2 stops image recording after counting a predetermined number of encoder pulses.

As described above, with the image recording apparatus 1 according to the first embodiment, the width of a recording medium being conveyed can be estimated even if the detection range of the medium side end detecting unit 6 is approximately one half of a width of a maximum size of a recording medium recorded by the image recording apparatus 1. Moreover, even with a compact and cost-effective configuration without a detector of a recording medium size, the width of a recording medium being conveyed can be estimated. Accordingly, even when a recording medium of an irregular size is conveyed, its recording range is estimated and recorded. As a result, ink can be prevented from jetting outside the recording medium, and the apparatus can be prevented from being contaminated by ink jetting.

The image recording apparatus 1 according to the first embodiment may be configured so that the warning unit 8 issues a warning to a user when a detection result of the medium side end detecting unit 6 exceeds a recording medium recordable range, and a recording operation is stopped. This case can occur, for example, when the recording medium 60 deviates from the midpoint Y of the conveyance path due to some trouble and is conveyed. Alternatively, the image recording apparatus 1 may be configured so that the warning unit 8 notifies a user of a fault and a recording operation is stopped when the estimated value 2e of the width of the recording medium 60 is determined not to match a predetermined regular size. Still alternatively, the image recording apparatus 1 may be configured so that the recording medium 60 is ejected without being recorded.

The first embodiment has been described by assuming that the paper feeding mechanism 30 does riot include a detector of a recording medium size. However, the above described method is naturally applicable also to a case where the paper feeding mechanism 30 does not include a recording medium size detector for detecting a recording medium of an irregular size although the paper feeding mechanisms 30 includes a recording medium size detector for detecting a recording medium of a regular size.

An image recording apparatus 1 according to the second embodiment is described next.

In the configuration of the image recording apparatus 1 according to the second embodiment, the image recording apparatus 1 according to the second embodiment is different from that according to the first embodiment in that a medium fence mechanism 31 includes a medium size detecting unit 34.

Figure 6:
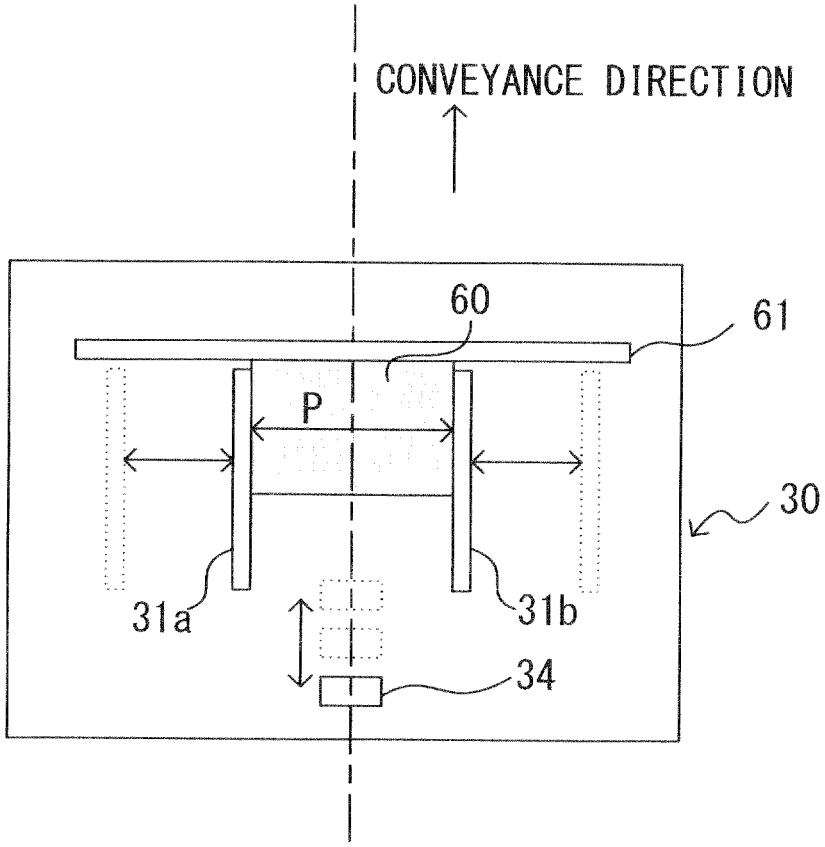
FIG. 6 illustrates a configuration of a paper feeding mechanism adopted in an image recording apparatus according to the second embodiment.

FIG. 6 illustrates a configuration of a paper feeding mechanism 30 adopted in the image recording apparatus 1 according to the second embodiment.

As illustrated in FIG. 6, the recording medium 60 held on the paper feeding mechanism 30 is set by being pressed against a fixture plate 61 provided on an upstream side of the conveyance direction. When a conveyance instruction is issued, recording media 60 are picked up and conveyed one by one from the top. The position of the paper feeding mechanism 30 may be restricted by a movable plate that is provided on a downstream side of the conveyance direction of the recording medium 60.

Additionally, the medium size detecting unit 34 is provided in the rear of the conveyance direction of the paper feeding mechanism 30. The medium size detecting unit 34 is moved and set by a user at a predetermined position of a suitable regular size so that the medium size detecting unit 34 is positioned at the rear edge of a recording medium when the recording medium 60 of the regular size is held. The position at which the medium size detecting unit 34 has been set is notified to the controlling unit 2, which then recognizes the size of the recording medium 60 set on the conveyance mechanism 30 on the basis of the notified position. Note that the medium size detecting unit 34 is set at any of a plurality of particular positions suitable for sizes of a recording medium 60. Accordingly, on the basis of the set position of the medium size detecting unit 34, the size of a recording medium 60 of a regular size can be detected, but the size of a recording medium 60 of an irregular size cannot be detected.

Figure 7:
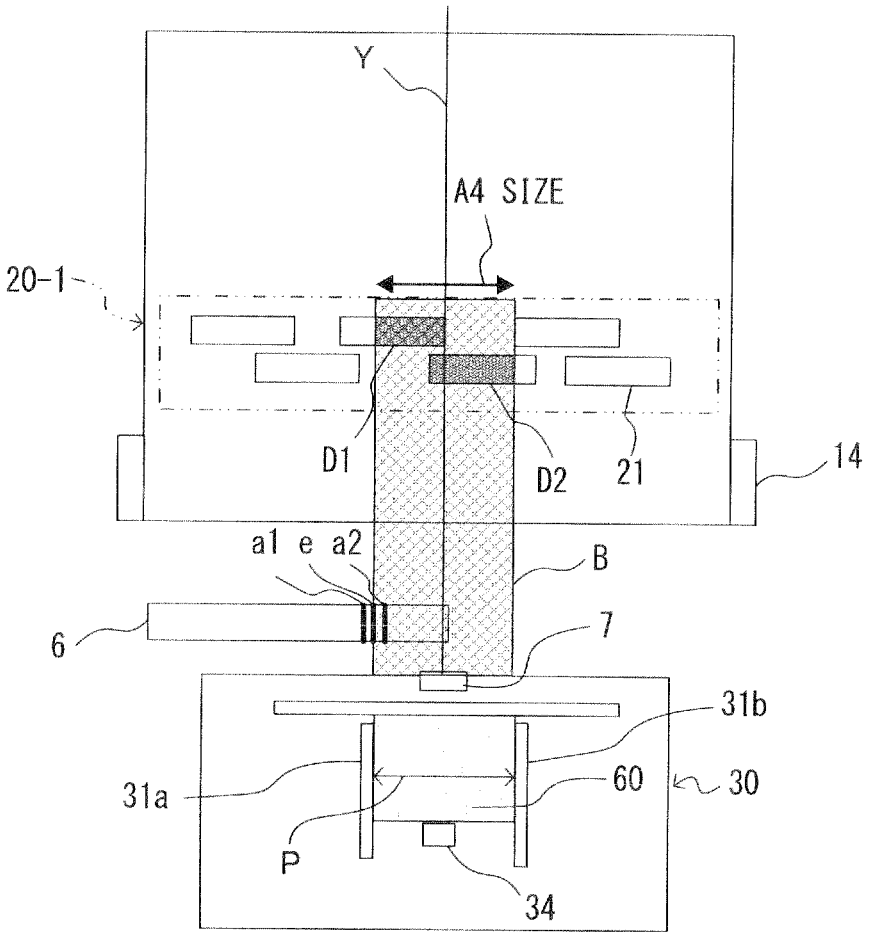
FIG. 7 is an explanatory view of a case where a suitably regular recording medium is held on a paper feeding stage of the image recording apparatus according to the second embodiment.

FIG. 7 is an explanatory view of case where a suitable regular recording medium 60 is held on a paper feeding stage 30 of the image recording apparatus 1 according to the second embodiment.

In FIG. 7, when the recording medium 60 is set in the image recording apparatus 1, for example, a recording medium 60 of an A4 size is held on the conveyance mechanism 30, and is pressed against fences 31*a*, 31*b* of the medium fence mechanism 31 by moving the fences 31*a* and 31*b*. Moreover, the medium size detecting unit 34 is set at the position of the A4 size. Then, a user verifies that the medium size detecting unit 34 has been set at the position of the A4 size.

When an image recording instruction is issued from the higher-level device 40 to the image recording apparatus 1 in this state, the controlling unit 2 recognizes that the size of the recording medium 60 being conveyed is the A4 size on the basis of the output of the medium size detecting unit 34, and the controlling unit 2 controls the conveyance mechanism 10 to start conveying the recording medium 60.

An end and edges of the recording medium 60 being conveyed are detected by the medium side end detecting unit 6 and the medium edge detecting unit 7 with the procedures described in the first embodiment. Then, the image recording range setting unit 3 estimates the recording medium width of the recording medium 60 being conveyed on the basis of, for example, a detection result of the left end. Here, assume that the detection value of the medium side end detecting unit 6 is e and a detection range of the recording medium 60 being conveyed, which the image recording range setting unit 3 determines to be the A4 size, is a range from a1 to a2. If the detection value e satisfies a1>e>a2 in this case, the estimated value of the recording medium width by the medium side end detecting unit 6 is within the predetermined range. Therefore, the controlling unit 2 determines that the width of the recording medium being conveyed is A4, and continues the recording operation. For the recording operation, a recording head driving range B has an A4-sized width.

In the meantime, a case where a recording medium of an irregular size having a width narrower than the A4 size is set on the paper feeding mechanism 30 while the medium size detecting unit 34 is left at the position where the size of the recording medium 60 that a user sets on the paper feeding mechanism 30 is detected to be A4 is considered. This case is illustrated in FIG. 8.

Figure 8:
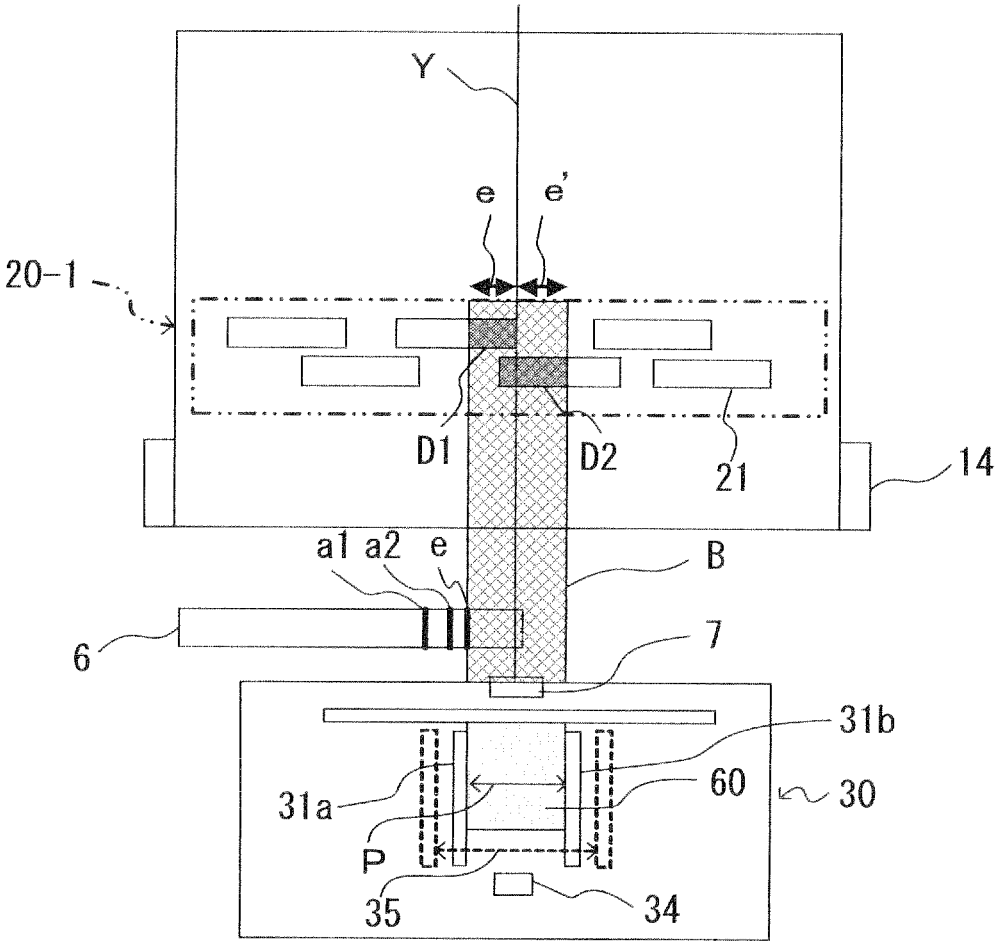
FIG. 8 is an explanatory view of a case where a recording medium of an irregular size is held on the paper feeding stage of the image recording apparatus according to the second embodiment.

In FIG. 8, the recording medium 60 having a width narrower than the A4 size is set on the paper feeding mechanism 30, and a distance P between the fences 31*a* and 31*b* is narrower than a width 35 of the A4 size. However, the position of the medium size detecting unit 34 is set at the position used when the recording medium 60 is an A4 size, and this position has been notified to the controlling unit 2.

If an image recording instruction is issued from the higher-level device 40 to the image recording apparatus 1 in such a state, the controlling unit 2 determines that the recording medium 60 of the A4 size is set, and starts conveying the recording medium 60. At this time, the image recording range setting unit 3 obtains an estimated value of the recording medium width of the recording medium 60 being conveyed on the basis of the detection result of the medium side end detecting unit 6. Since the recording medium 60 being conveyed in the case of FIG. 8 is of an irregular size, the estimated value 2e exceeds the error range of the width of the A4 size, which is notified from the medium size detecting unit 34.

In this case, the image recording range setting unit 3 determines the width of the recording medium 60 being conveyed to be 2e and sets the recording head driving range B to 2e so as to perform a recording operation. Alternatively, depending on settings made by a user, a warning may be issued to the user and the recording operation may be stopped, or the recording medium may be conveyed and ejected without being recorded.

As described above, in the second embodiment, the image recording range setting unit 3 can set an accurate recording head driving range B even if the size of the recording medium 60, which is recognized based on the position of the medium size detecting unit 34 of the paper feeding mechanism 30, is different from an estimated value of the size of the recording medium 60 being conveyed. As a result, the inside of the apparatus can be prevented from being contaminated by ink jetting.

Additionally, also in the second embodiment, the detection range of the medium side end detecting unit 6 is approximately one half of the size of the recording medium 60, whereby the image recording apparatus 1 can be reduced in size and cost.

An image recording apparatus accord to the third embodiment is described next.

In the configuration of the image recording apparatus 1 according to the third embodiment, the image recording apparatus 1 according to the third embodiment is different from those according to the first and the second embodiments in a point that the medium fence mechanism 31 of the paper feeding mechanism 30 includes a detecting unit capable of detecting the width of a recording medium 60 of an irregular size.

In the first embodiment, a recording medium width is obtained by estimating the width of the recording medium 60 conveyed along the midpoint of the conveyance path on the basis of a detection result of the medium side end detecting unit 6, and thereby the recording head driving range B is set. In contrast, in the third embodiment, a recording medium width is obtained by using a recording medium width detected by the medium fence mechanism 31.

If the recording medium width detected by the medium fence mechanism 31 is within a predetermined range, an image recording range is set by recognizing the detected recording medium width as the recording medium width of the recording medium 60, and an image recording process is executed on this range. If the detected recording medium width is not within the predetermined range, the recording medium width of the recording medium 60 being conveyed is determined by using the estimated value 2e of the recording medium width of the recording medium 60, which is estimated based on the detection result of the medium side end detecting unit 6, and the image recording process is executed by setting the image recording range in a similar manner as in the first embodiment.

Figure 9:
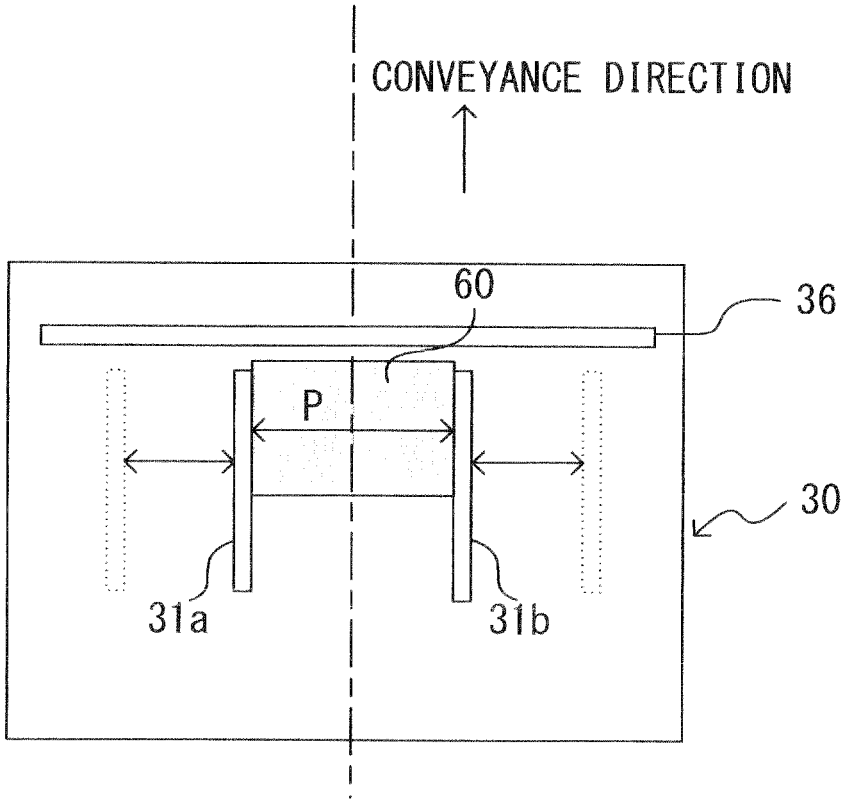
FIG. 9 illustrates a configuration of a paper feeding mechanism of the image recording apparatus according to the third embodiment.

FIG. 9 illustrates a configuration of a paper feeding mechanism 30 of the image recording apparatus 1 according to the third embodiment.

The paper feeding mechanism 30 illustrated in FIG. 9 includes not the medium size detecting unit 34 of the paper feeding mechanism 30 in the second embodiment illustrated in FIG. 6 but the detecting unit 36 for detecting a distance P between the fences 31*a* and 31*b* and for notifying the controlling unit 2 of the detected distance P. The detecting unit 36 detects positions where the fences 31*a* and 31*b* are set, obtains the distance P on the basis of the set positions, and notifies the controlling unit 2 of the distance P.

In the third embodiment, the detecting unit 36 detects the distance P between the fences 31*a* and 31*b*. Therefore, even if a recording medium 60 of an irregular size is set on the paper feeding mechanism 30, the detecting unit 30 can detect its recording medium width.

In the first embodiment, the width of the recording medium conveyed along the midpoint of the conveyance path is estimated based on the detection result of the medium side end detecting unit 6, and whether or not the estimated width is within a predetermined range of a regular size is determined. In the third embodiment, a predetermined range of a regular size is compared with a recording medium width detected by the detecting unit 36. If the recording medium width detected by the detecting unit 36 is within a predetermined range as a result of the determination, the width is determined to be almost equal to the recording medium width detected by the detecting unit 36, and image recording is performed with the recording medium width detected by the detecting unit 36. If the detected recording medium width is not within the predetermined range, the flow proceeds to a process for determining whether or not 2e is within a predetermined range in a similar manner as in the first embodiment.

An image recording apparatus 1 according to the fourth embodiment is described next.

The image recording apparatus 1 according to the fourth embodiment is basically identical to that according to the first embodiment except that a control program executed by the controlling unit 2 is different. A paper feeding mechanism 30 may have any of the configurations referred to in the first to the third embodiments.

The image recording apparatus 1 according to the fourth embodiment uses information R of a recording medium size, which is included in job information that is notified from the higher-level device 40 and is used to record an image when a recording start is notified from the higher-level device 40, the controlling unit 2 recognizes the width of the recording medium 60 being conveyed on the basis of the information R of the recording medium size within the job information notified from the higher-level device 40, and starts conveying the recording medium 60. In a similar manner as in the first embodiment, one end (such as the left end) of the recording medium 60 is detected by the medium side end detecting unit 6 while the recording medium 60 is being conveyed on the conveyance path, and an estimated value 2e of the width of the recording medium 60 is obtained based on the detection result. If the estimated value 2e is within an error range of the recording medium width obtained based on the job information, an image recording range is determined based on the recording medium width obtained based on the job information. If the estimated value 2e exceeds the error range, the image recording range is determined by recognizing the estimated value 2e as the recording medium width, or the warning unit 8 issues a warning to a user and a recording operation is stopped.

As described above, even if a recording medium 60 of an irregular size is used also in the image recording apparatus 1 according to the fourth embodiment, image recording is performed by obtaining an image recording range on the basis of the width of the recording medium. As a result, the image recording can be performed while preventing the inside of the apparatus being contaminated.

Figure 10:
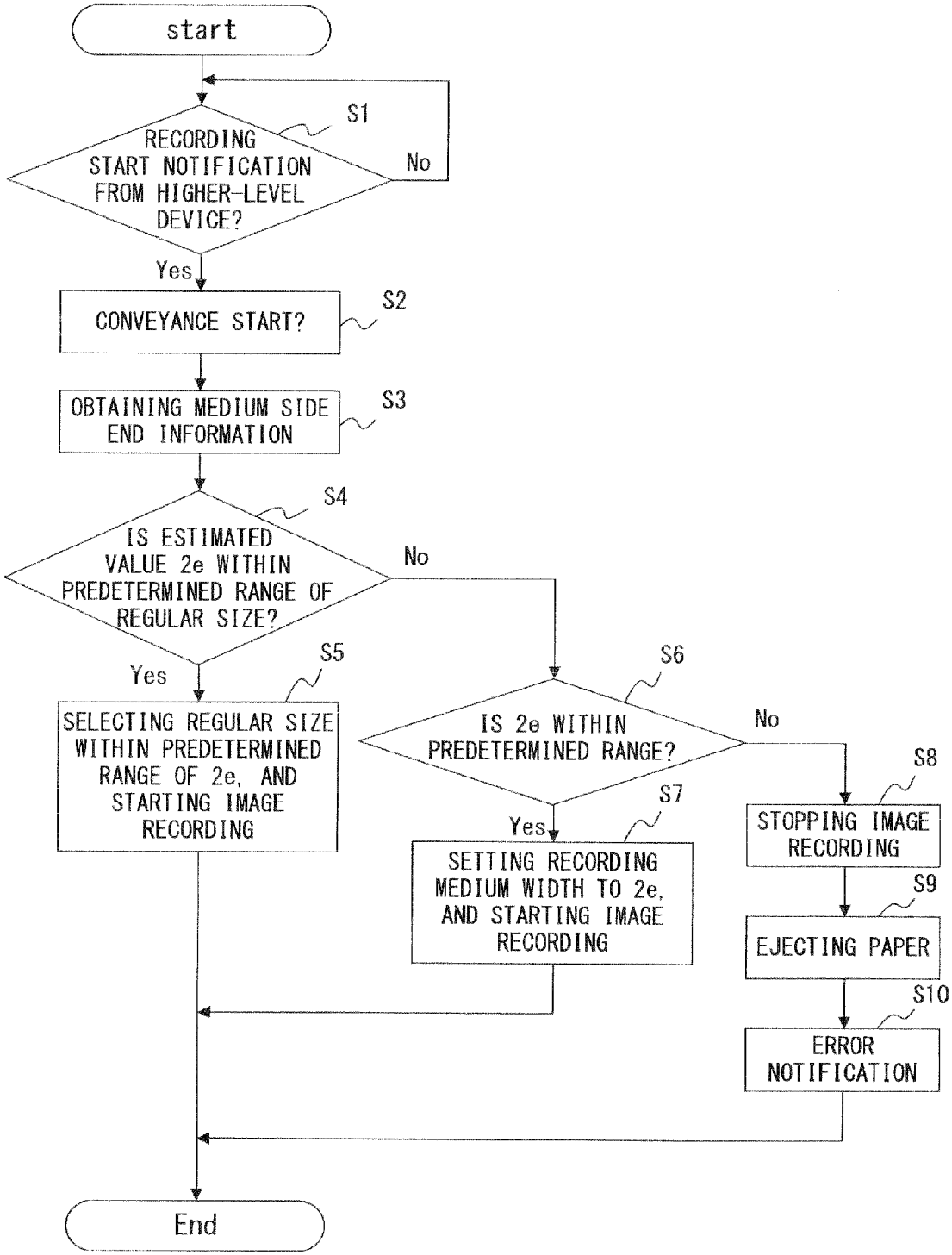
FIG. 10 is a flowchart illustrating a process executed when the image recording apparatus according to the first embodiment records an image.

FIG. 10 is a flowchart illustrating a process executed when the image recording apparatus 1 according to the first embodiment performs image recording. This process is implemented in a way such that a processing circuit of the controlling unit 2 executes a program corresponding to the image recording range setting unit 3 or a control program in the memory.

The controlling unit 2 examines, in step S1, whether or not job information is notified from the higher-level device 40 as a recording start notification, and waits until the job information is notified. ("NO" in step S1).

When the job information for notifying the recording start is transmitted from the higher-level device 40 in step S1 ("YES" in step S1), the controlling unit 2 controls the conveyance mechanism 10 and the paper feeding mechanism 30 to start conveying the recording medium 60 set on the paper feeding mechanism 30 in step 32.

Upon detection of one end (such as the left end) of the recording medium 60 by the medium side end detecting unit 6 while the recording medium 60 is being conveyed on the conveyance path in step S3, the controlling unit 2 obtains an estimated value 2e of a recording medium width on the basis of the detection result.

Then, in step 34, the controlling unit 2 determines whether or not the estimated value 2e obtained in step S3 is within a predetermined error range of a regular size value. If the estimated value 2e is within the predetermined error range as a result of the determination ("YES" in step 4), image recording is started by determining the width of the regular size which includes the estimated value 2e within the predetermined error range as the width of the recording medium 60 being conveyed in step S5. Then, this process is terminated.

In contrast, in step S4, if the controlling unit 2 determines that the estimated value 2e is not within predetermined error ranges of any regular size values ("NO" in step S4), the controlling unit 2 determines whether or not the estimated value 2e is within a predetermined range in step S6. If the estimated value 2e is determined to be within the predetermined range ("YES" in step 36), a recording range is determined by stipulating the width of the recording medium 60 being conveyed to be 2e, and image recording is started in step S7. Then, this process is terminated.

In step S6, if the estimated value 2e is determined not to be within the predetermined range ("NO" in step S6), the recording medium 60 currently being conveyed is a medium having a width that cannot be recorded. Therefore, the controlling unit 2 stops the image recording process in step S8. Thereafter, the recording medium 60 is ejected in step 39. Then, the controlling unit 2 controls the warning unit 8 to make an error notification to a user in step S10. Then, this process is terminated.

With the image recording apparatus 1 according to the first embodiment, a recording medium width is estimated based on a detection result of the medium side end detecting unit 6 while the recording medium 60 is being conveyed. An image recording range is determined by using the estimated value 2e. Therefore, image recording can be performed even on a recording medium 60 of an irregular size while preventing the inside of the apparatus being contaminated by ink or toner.

Figure 11:
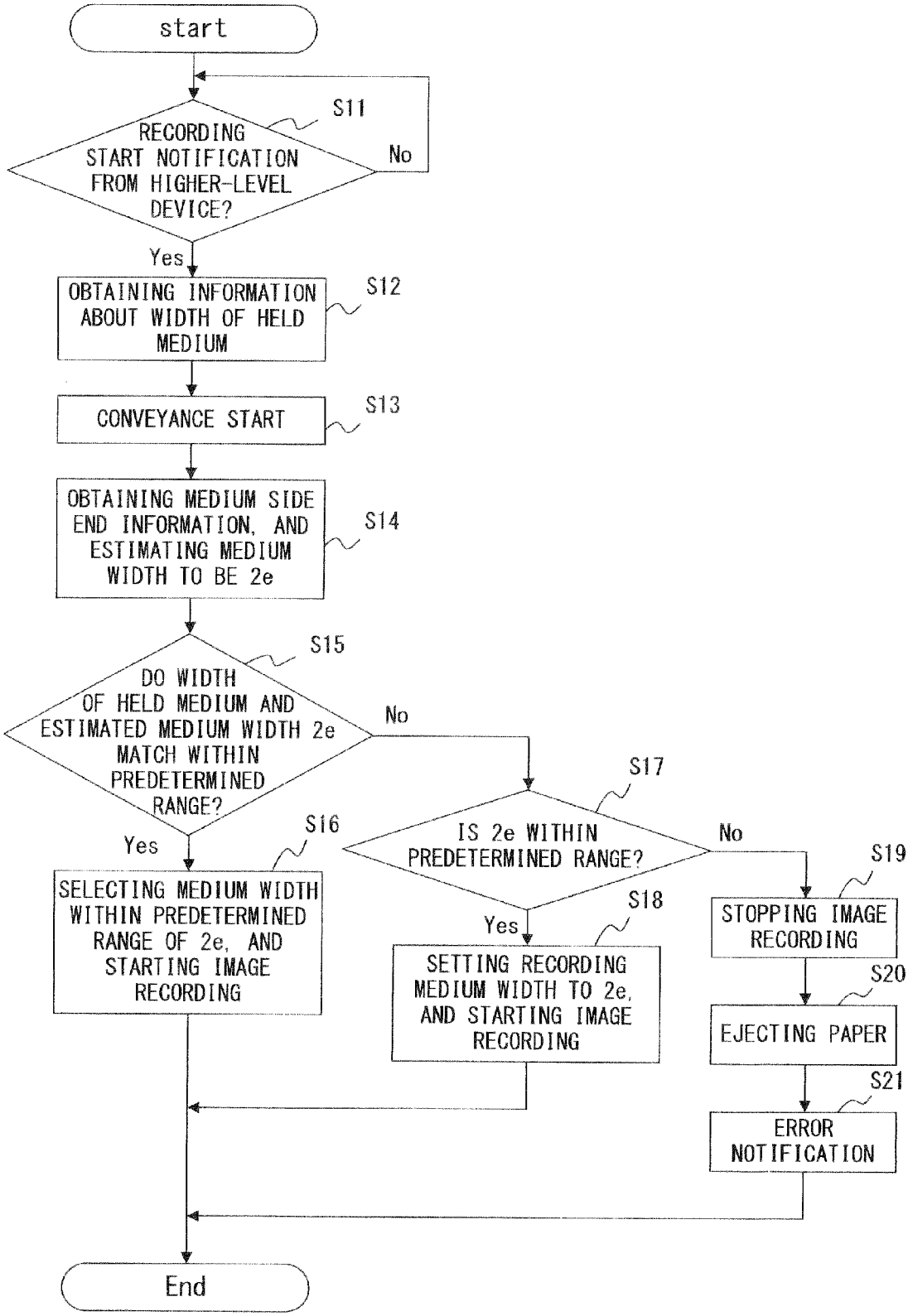
FIG. 11 is a flowchart illustrating a process executed when the image recording apparatus according to the second or the third embodiment records an image.

FIG. 11 is a flowchart illustrating a process executed when the image recording apparatus 1 according to the second or the third embodiment performs image recording. Also this process is implemented in away such that the processing circuit of the controlling unit 2 executes a program corresponding to the image recording range setting unit 3 or a control program in the memory.

Once the process of FIG. 11 is started, the controlling unit 2 examines, in step S11, whether or not job information is notified from the higher-level device 40 as a recording start notification, and waits until the job information is notified ("NO" in step S11).

In step S11, when the job information for notifying the recording start is transmitted from the higher-level device 40 ("YES" in step S11), the controlling unit 2 obtains information about the width of a held recording medium 60 from the paper feeding mechanism 30 in step S12. At this time, the controlling unit 2 obtains the recording medium width on the basis of information notified from the medium size detecting unit 34 in the image recording apparatus 1 according to the second embodiment, or information notified from the detecting unit 36 in the image recording apparatus 1 according to the third embodiment.

Next, the controlling unit 2 controls the conveyance mechanism 10 and the paper feeding mechanism 30 to start conveying the recording medium 60 held on the paper feeding mechanism 30 in step S13.

Upon detection of one end (such as the left end) of the recording medium 60 by the medium side end detecting unit 6 while the recording medium 60 is being conveyed on the conveyance path, the controlling unit 2 obtains an estimated value 2e of the recording medium width on the basis of the detection result in step S14.

Then, in step S15, the controlling unit 2 makes a comparison between the estimated value 2e obtained in step S14 and the recording medium width obtained in step S12, and determines whether or not the estimated value 2e and the recording medium width match within a predetermined error range. If the estimated value 2e and the recording medium width match within the predetermined error range as a result of the determination ("YES" in step S15), the controlling unit 2 determines an image recording range by using the recording medium width obtained in step S12, and starts image recording in step S16. Then, this process is terminated.

In contrast, in step S15, if the controlling unit 2 determines that the estimated value 2e and the recording medium width do not match within the predetermined error range ("NO" in step S15), processes similar to those in steps S6 to S10 of FIG. 10 are executed in steps S17 to S21. Then, this process is terminated.

With the image recording apparatus 1 according to the second or the third embodiment, an image recording range is determined by using a recording medium width notified from the paper feeding mechanism 30, and an estimated value 2e obtained on the basis of a detection result of the medium side end detecting unit 6. Therefore, this apparatus can also cope with a recording medium 60 of an irregular size in a similar manner as in the first embodiment, and the inside of the apparatus can be prevented from being contaminated by ink, toner or the like at the time of the image recording process.

Figure 12:
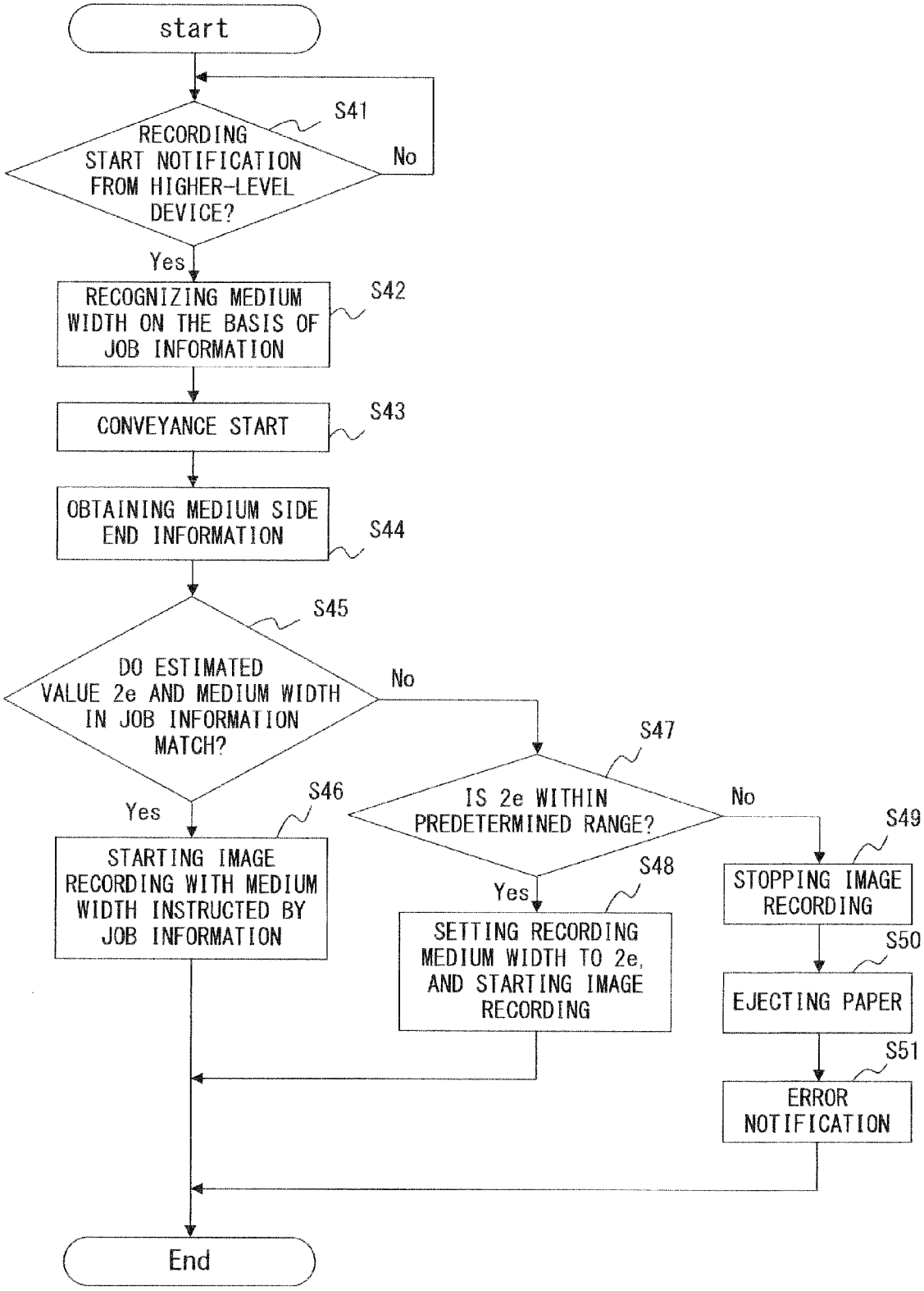
FIG. 12 is a flowchart illustrating a process executed when the image recording apparatus according to the fourth embodiment records an image.

FIG. 12 is a flowchart illustrating a process executed when the image recording apparatus 1 according to the fourth embodiment performs image recording. Also this process is implemented in a way such that the processing circuit of the controlling unit 2 executes a program corresponding to the image recording range setting unit 3 or a control program in the memory.

Once the process of FIG. 12 is started, the controlling unit 2 initially waits until job information is notified from the higher-level device 40 as a recording start notification in step S41 ("NO" in step S41). This step S41 is identical to step S1 of FIG. 10 and step S11 of FIG. 11.

Upon receipt of the job information for notifying the recording start from the higher-level device 40 in step S41 ("YES" in step S41), the controlling unit 2 recognizes recording medium width on the basis of image data size information within the job information in step S42.

Next, the controlling unit 2 controls the conveyance mechanism 10 and the paper feeding mechanism 30 to start conveying the recording medium 60 held on the paper feeding mechanism in step S43.

Upon detection of one end (such as the left end) of the recording medium 60 by the medium side end detecting unit 6 while the recording medium 60 is being conveyed on the conveyance path, the controlling unit 2 obtains an estimated value 2e of the medium width on the basis of the detection result in step S44.

Then, in step S45, the controlling unit 2 makes a comparison between the estimated value 2e obtained in step S44 and the recording medium width obtained from the job information in step S42, and determines whether or not the estimated value 2e and the recording medium width match within a predetermined error range. If the estimated value 2e and the recording medium width match within the predetermined error range as a result of the determination ("YES" in step S45), the controlling unit 2 determines an image recording range by using the recording medium width specified in the job information obtained in step S42, and starts the image recording process in step S46. Then, this process is terminated.

In contrast, if the controlling unit 2 determines that the estimated value 2e and the recording medium width do not match within the predetermined error range as a result of the determination in step S45 ("NO" in step S45), processes similar to those in steps S6 to S10 of FIG. 10 are executed in steps S47 to S51. Then, this process is terminated.

Also with the image recording apparatus 1 according to the fourth embodiment, an image recording range is determined by using a recording medium width specified along with recording start notification from the higher-level device 40, and an estimated value 2e obtained from a detection result of the medium side end detecting unit 6. Therefore, the image recording apparatus 1 according to the fourth embodiment can also cope with a recording medium 60 of an irregular size in a similar manner as in the first to the third embodiments, and the inside of the apparatus can be prevented from being contaminated by ink, toner or the like at the time of the image recording process.

As described above, the image recording apparatuses 1 according to the first to the fourth embodiments of the present invention can cope with a case where a recording medium of an irregular size is conveyed or a case where the size of a recording medium being conveyed cannot be recognized. Also in such cases, image recording can be performed by preventing the inside of the apparatus from being contaminated by jetting ink outside a range of the recording medium.

Additionally, the plurality of components disclosed in the image recording apparatuses 1 according to the first to the fourth embodiments may be suitably combined. Alternatively, some components may be deleted from the entire configurations referred to in the first to the fourth embodiments, or some of the components of another embodiment may be suitably combined with the components in the first to the fourth embodiments.

Furthermore, for example, the medium side end detecting unit 6 may be configured to detect the right end of a recording medium. Alternatively, the control referred to in this specification may be performed if either of medium side end detecting units 6 arranged on the right and the left sides is determined to improperly operate.

Still further, roll paper may be used as the recording medium 60 in the first, the third and the fourth embodiments.

Still further, a recording medium width is estimated based on the premise that the recording medium 60 is conveyed along the approximate midpoint of the conveyance path in the above described embodiments. However, the image recording apparatuses 1 according to embodiments of the present invention can obtain in advance a point along which the recording medium 60 is conveyed in a main scanning direction of the conveyance path. Therefore, if the width of the recording medium 60 can be estimated based on that point, the recording medium 60 may be conveyed along a point of, for example, one-third or two-fifth of the conveyance path in the main scanning direction without assuming that the recording medium 60 is conveyed along the midpoint of the conveyance path.

What is claimed is:

1. An image recording apparatus for recording an image on a recording medium based on information from a higher-level device, the image recording apparatus comprising:

a paper feeding mechanism for feeding the recording medium, the paper feeding mechanism including a medium fence for aligning the recording medium by pressing against both side ends of the recording medium, the side ends being parallel to a conveyance direction of the recording medium, so that a center of the recording medium in a direction orthogonal to the conveyance direction coincides with a midpoint of a conveyance path in the direction orthogonal to the conveyance direction;

a recording medium side end detecting unit having a detection length that is approximately one half of a maximum width of a recording medium that is conveyable in the conveyance path, the recording medium side end detecting unit detecting a distance from the midpoint of the conveyance path in the direction orthogonal to the conveyance direction to a position of one of the side ends of the recording medium; and an image recording range setting unit which estimates a width of the recording medium to be twice the distance detected by the recording medium side end detecting unit, which sets a recording range on which image recording is to be performed, based on the estimated width, and which executes an image recording process on the recording range.

2. The image recording apparatus according to claim 1, wherein if the width of the recording medium, which is estimated based on a detection result of the recording medium side end detecting unit, is different from a preset value, the image recording range setting unit conveys and ejects the recording medium without executing the image recording process.

3. The image recording apparatus according to claim 1, wherein if the width of the recording medium, which is estimated based on a detection result of the recording medium side end detecting unit, is different from a preset value, the image recording range setting unit makes an error notification to a user without executing the image recording process.

4. The image recording apparatus according to claim 1, further comprising a medium edge detecting unit for detecting an edge of the recording medium in the conveyance direction, wherein a time point when the medium edge detecting unit detects a front edge of the recording medium in the conveyance direction is used as a trigger for measuring image recording start timing, and a time point when the medium edge detecting unit detects a rear edge of the recording medium is used as a trigger for measuring image recording end timing.

5. The image recording apparatus according to claim 1, further comprising a detecting unit, provided in the paper feeding mechanism, for detecting a size of the recording medium, wherein the image recording range setting unit makes a comparison between a medium width obtained based on the size of the recording medium which is detected by the detecting unit, and the width of the recording medium which is estimated based on a detection result of the recording medium side end detecting unit, and sets the recording range based on the medium width if the estimated width and the medium width match within a predetermined error range.

6. The image recording apparatus according to claim 5, wherein:

the detecting unit is movable between a plurality of predetermined positions so as to be disposed at one position from among the plurality of predetermined positions;

each of the plurality of predetermined positions is suitable for a size of a recording medium so that the detecting unit detects, at each of the plurality of predetermined positions, a rear edge of the recording medium in the conveyance direction while the recording medium is held on the paper feeding mechanism, the detecting unit notifies the image recording range setting unit of the one position at which it is disposed, and the image recording range setting unit recognizes, based on the one position at which the detecting unit is disposed, a size of the recording medium held on the paper feeding mechanism.

7. The image recording apparatus according to claim 5, wherein the paper feeding mechanism further includes a fence mechanism comprising the medium fence, wherein the detecting unit notifies the image recording range setting unit of a size of the recording range based on a set position of the fence mechanism.

8. The image recording apparatus according to claim 5, wherein the image recording range setting unit (i) makes a comparison between the medium width obtained based on the size of the recording medium which is detected by the detecting unit, and the width of the recording medium which is estimated based on the detection result of the recording medium side end detecting unit, (ii) determines whether or not the estimated width is within a predetermined range if the estimated width and the medium width do not match within the predetermined error range, and (iii) sets the recording range by using the estimated width if the estimated width is within the predetermined range.

9. The image recording apparatus according to claim 8, wherein the image recording range setting unit issues a warning without executing the image recording process if the estimated width of the recording medium is not within the predetermined range.

10. The image recording apparatus according to claim 8, wherein the image recording range setting unit ejects the recording medium without executing the image recording process if the estimated width of the recording medium is not within the predetermined range.

11. The image recording apparatus according to claim 1, wherein the image recording range setting unit makes a comparison between a medium width obtained based on a size of the recording medium as instructed by the information from the higher-level device, and the width of the recording medium, which is estimated based on a detection result of the recording medium side end detecting unit, and sets the recording range based on the the medium width if the estimated width and the medium width match within a predetermined error range.

12. A controlling method for an image recording apparatus which records an image on a recording medium based on information from a higher-level device, the method comprising:

feeding the recording medium with a paper feeding mechanism, the paper feeding mechanism including a medium fence for aligning the recording medium by pressing against both side ends of the recording medium, the side ends being parallel to a conveyance direction of the recording medium, so that a center of the recording medium in a direction orthogonal to the conveyance direction coincides with a midpoint of a conveyance path in the direction orthogonal to the conveyance direction;

detecting, with a recording medium side end detecting unit having a detection length that is approximately one half of a maximum width of a recording medium that is conveyable in the conveyance path, a distance from the midpoint of the conveyance path in the direction orthogonal to the conveyance direction to a position of one of the side ends of the recording medium being conveyed on the conveyance path;

estimating a width of the recording medium to be twice the detected distance;

setting a recording range, on which image recording is to be performed, based on the estimated width; and executing an image recording process on the recording range.

13. The controlling method according to claim 12, wherein the setting includes:

making a comparison between a medium width obtained based on a size of the recording medium, which is detected by a detecting unit provided in the paper feeding mechanism to detect the size of the recording medium, and the estimated width of the recording medium; and setting the recording range based on the medium width if the estimated width and the medium width match within a predetermined error range.

14. The controlling method according to claim 12, wherein the setting includes:

making a comparison between a medium width obtained based on a size of the recording medium as instructed by the information provided from the higher-level device, and the estimated width of the recording medium; and setting the recording range based on the medium width if the estimated width and the medium width match within a predetermined error range.

* * * * *